US006135123A

United States Patent [19]

Grassi et al.

[11] Patent Number: 6,135,123

[45] Date of Patent: Oct. 24, 2000

[54] HAIR CUTTING GUIDE

[76] Inventors: Judy Grassi, 1170 Willow Bend, Broadview Hts., Ohio 44147; Robert L. Kovach, 5765 Brecksville Rd., Independence, Ohio 44131

[21] Appl. No.: 09/140,566

[22] Filed: Aug. 27, 1998

[51] Int. Cl.[7] ..... A45D 24/34; A45D 24/36; A45D 8/00

[52] U.S. Cl. ..... 132/213; 132/213.1; 132/214; 132/276

[58] Field of Search ..... 132/213, 213.1, 132/214, 212, 276, 277, 278, 273, 275; 30/195, 175, 178, 193

[56] References Cited

U.S. PATENT DOCUMENTS

| | | | |
|---|---|---|---|
| 2,272,580 | 2/1942 | Phillips | 30/195 |
| 3,242,564 | 3/1966 | Longhini | 29/434 |
| 3,247,852 | 4/1966 | Schneider | 128/346 |
| 3,250,282 | 5/1966 | Thatcher | 132/275 |
| 3,279,479 | 10/1966 | Solomon | 132/273 |
| 3,928,871 | 12/1975 | Wall | 132/213.1 |
| 5,012,830 | 5/1991 | Vaccaro et al. | 132/213.1 |
| 5,427,122 | 6/1995 | Hamilton | 132/214 |
| 5,706,839 | 1/1998 | Patti | 132/277 |
| 5,758,672 | 6/1998 | Chou | 132/275 |
| 5,865,190 | 2/1999 | Butler | 132/208 |

*Primary Examiner*—John J. Wilson
*Assistant Examiner*—Robyn Kieu Doan
*Attorney, Agent, or Firm*—Woodling, Krost and Rust

[57] ABSTRACT

A hair cutting guide comprising an upper clip and a lower clip is disclosed. A pivot pin interconnects the upper and lower clips allowing rotation of the upper and lower clip with respect to each other. A spring is mounted around the pivot pin and engages the upper and lower clips and urges them into engagement with each other. The upper clip includes a toothed ridge and the lower clip includes a groove which mates with the toothed ridge. The lower clip also includes a toothed ridge which mates with a groove in the upper clip.

2 Claims, 6 Drawing Sheets

HAIR CUTTING GUIDE

FIELD OF THE INVENTION

This invention relates to a hair cutting guide which is used to facilitate hair cutting and grooming.

BACKGROUND OF THE INVENTION

U.S. Pat. No. 3,928,871 to Wall illustrates a barber's glove that is worn over the hand of a barber. The glove includes adjacent fingers for controlling the hair being cut. Other hair cutting guides are shown in U.S. Pat. No. 2,917,055 to Fouche and U.S. Pat. No. 2,670,744 to Levin.

U.S. Pat. No. 4,520,565 to Maggiore illustrates a hair cutting guide apparatus which provides an even cut of the hair by spacing or by controlling the distance that the hair is cut away from the persons head. The patent to Maggiore does disclose a pivot means about which two fingers may be rotated.

The foregoing patents have as their goal cutting hair to uniform length. None of the prior art discloses a hair cutting guide which is comprised of an upper clip and a lower clip which includes interleaving ridges to hold the hair and provide a cutting surface upon which the hair may be cut.

SUMMARY OF THE INVENTION

A hair cutting guide comprising an upper and a lower clip is disclosed. A pivot pin inner connecting the upper and lower clips allows rotation of the upper and lower clips with respect to each other. A spring mounted around the pivot pin engages the upper and lower clips and urges them into engagement with each other. The upper and lower clips include a plurality of toothed ridges and a plurality of depressions. The toothed ridges of the upper and lower clips mate with a plurality of depressions in the upper and lower clips. The plurality of toothed ridges of the upper clip are aligned with the plurality of the toothed ridges of the lower clip. This enables the strands of hair to be inserted between the spacing of the teeth on the ridges. This allows for the hair to be gripped uniformly by the upper and lower clip.

It is an object of the present invention to provide a hair cutting guide which includes an upper and lower clip with each clip including a plurality of toothed ridges and a plurality of depressions.

It is a further of the present invention to provide a hair cutting guide comprising an upper and a lower clip wherein each of the upper and lower clips has toothed ridges and depressions which interfit.

It is an object of the present invention to provide a hair cutting guide which provides surfaces which guide scissors or shears to cut hair.

It is an object of the present invention to provide a hair cutting guide which includes an upper clip having three toothed ridges and a lower clip which includes two toothed ridges. The ridges of the upper clip interfit with grooves and or depressions of the lower clip. Similarly the toothed ridges of the lower clip interfit in depressions or grooves of the upper clip.

It is an object of the present invention to provide a hair cutting guide which includes an upper and a lower clip, each of said clips having a plurality of toothed ridges which interfit with the other, and which are manipulated by the user by means of a thumb grip located on each clip.

It is an object of the present invention to provide a hair cutting guide which includes an upper and a lower clip, and toothed ridges on said upper and lower clips, wherein the teeth of each ridge are spaced apart so as to permit hair to reside within the space of the teeth.

It is an object of the present invention to provide a hair cutting guide comprising an upper and lower clip wherein each of said upper and lower clips includes toothed ridges while none of the toothed ridges of the upper and lower clips interface with each other.

The objects of the invention will be better understood when taken in conjunction with the Brief Description of the Drawings and the Detailed Description of the Invention which follows.

DETAILED DESCRIPTION OF THE INVENTION

Figure 1:
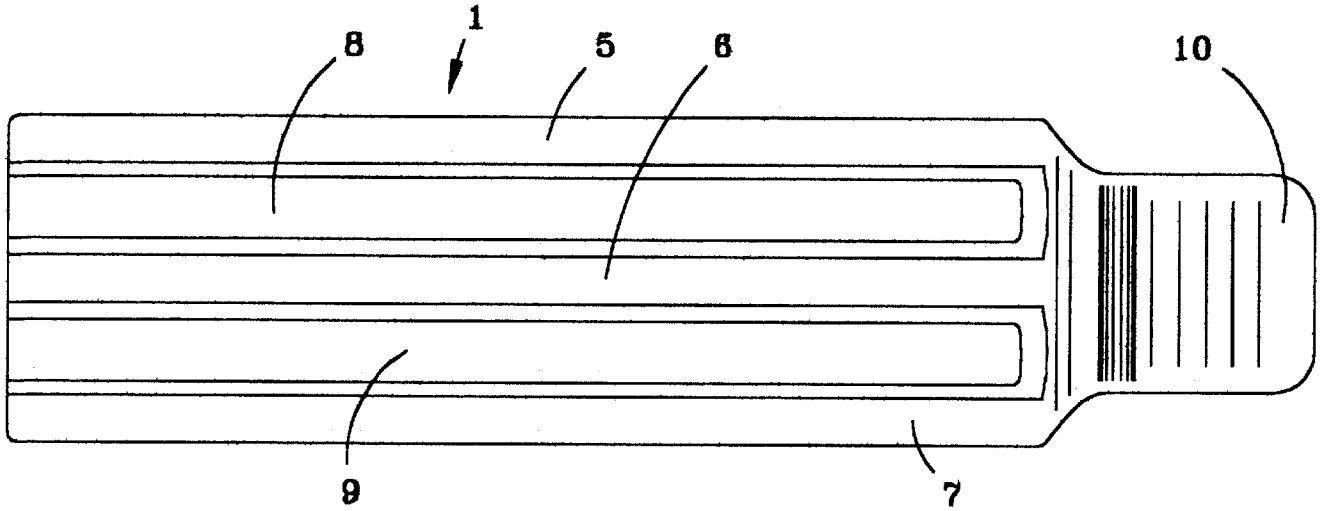
FIG. 1 is a top view of the upper clip of the hair cutting guide.

FIG. 1 is a top view of the upper clip 1 of the hair cutting guide 20. FIG. 1 illustrates a first exterior ridge 5, a second exterior ridge 6, and a third exterior ridge 7.

Figure 2:
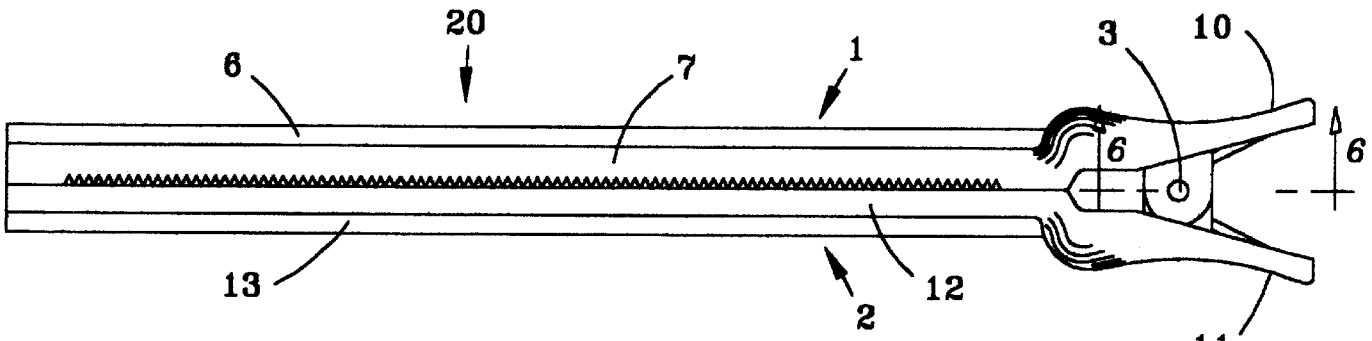
FIG. 2 is a side view of the hair cutting guide.

FIG. 2 is a side view of the hair cutting guide. FIG. 2 illustrates that the second exterior ridge of the upper clip is raised above the other exterior ridges. Referring back to FIG. 1, first exterior groove 8 and second exterior groove 9 can be viewed.

Figure 1A:
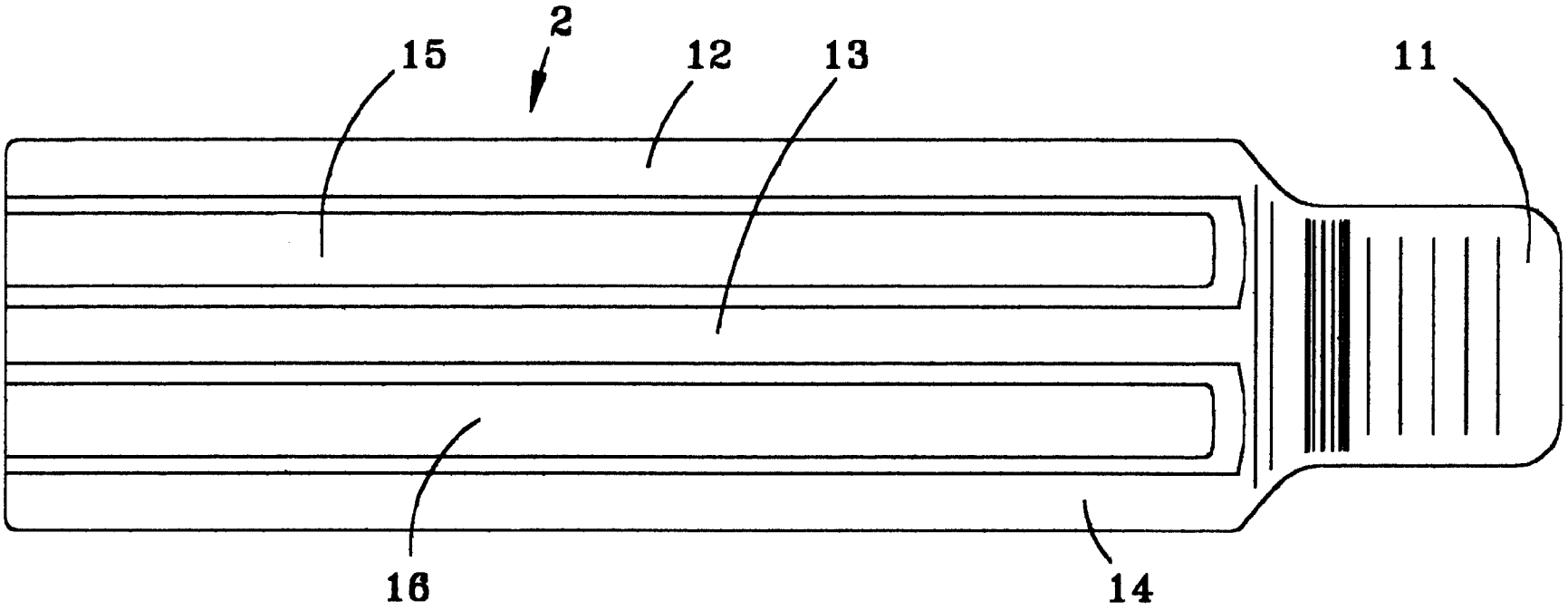
FIG. 1A is a top view of the lower clip of the hair cutting guide.

FIG. 1A is a top view of the lower clip 2 of the hair cutting guide 20. As will be noticed, FIG. 1A is identical to FIG. 1. FIG. 1A illustrates first exterior ridge 12, second exterior ridge 13, and third exterior ridge 14. Referring to FIG. 2 again, it will be seen that the second exterior ridge 13 is raised above the third exterior ridge. FIGS. 1 and 1A illustrate the thumb grips 10 of the upper clip and 11 of the lower clip respectively. FIG. 1A illustrates the first exterior groove 15 and the second exterior groove 16 of the lower clip 2.

FIG. 2 illustrates the lower clip 2 and the pivot pin 3. Upper clip 1 and lower clip 2 rotate about the pivot pin 3 when the thumb grip 10 and the thumb grip 11 are urged toward each other against the resistance of spring 4.

Figure 3:
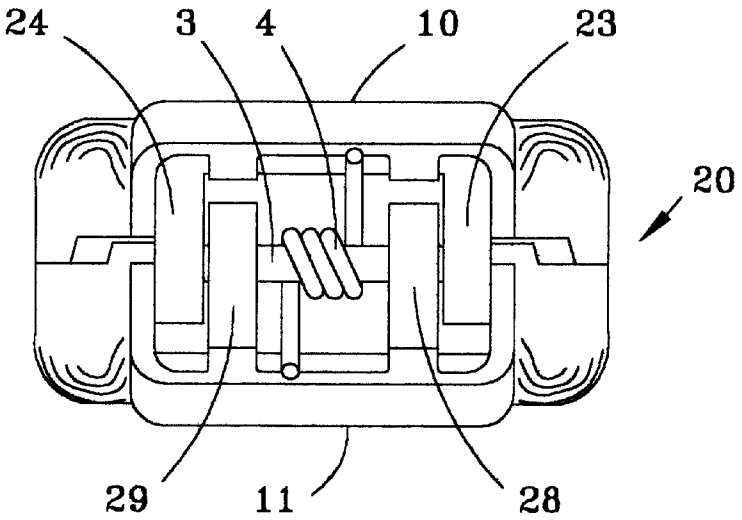
FIG. 3 is an enlarged end view of the hair cutting guide illustrating the pivoting end portion thereof.

FIG. 3 is an end view of the hair cutting guide 20 illustrating the pivoting end thereof. Coil spring 4 resides about pivot pin 3 and contacts thumb grip 10 and thumb grip 11. Specifically, the spring 4 contacts the interior of the thumb grip 10 and the interior of the thumb grip 11. Hair is gripped by the teeth of the hair cutting guide and scissors may be used to trim hair using the guide as a supporting surface upon which to cut. The upper and lower clip have identical exterior dimensions. When the clips grip the hair, either longitudinal edge may be used as a guide for the scissors. Referring to FIG. 2, one such longitudinal edge is shown and is defined by exterior ridge 7 of the upper clip 1 and exterior ridge 12 of the lower clip 2.

FIG. 3 also illustrates the first pivot support 23 of the upper clip 1 and the second pivot support 24 of the upper clip 1.

FIG. 3 also shows the first pivot support 28 for lower clip 2 and the second pivot support 29 for lower clip 2. The first and second pivot supports for lower clip 2 are integral with the lower clip 2. The first and second pivot supports 23 and 24 for the upper clip 1 are integral with the upper clip 1.

Figure 4:
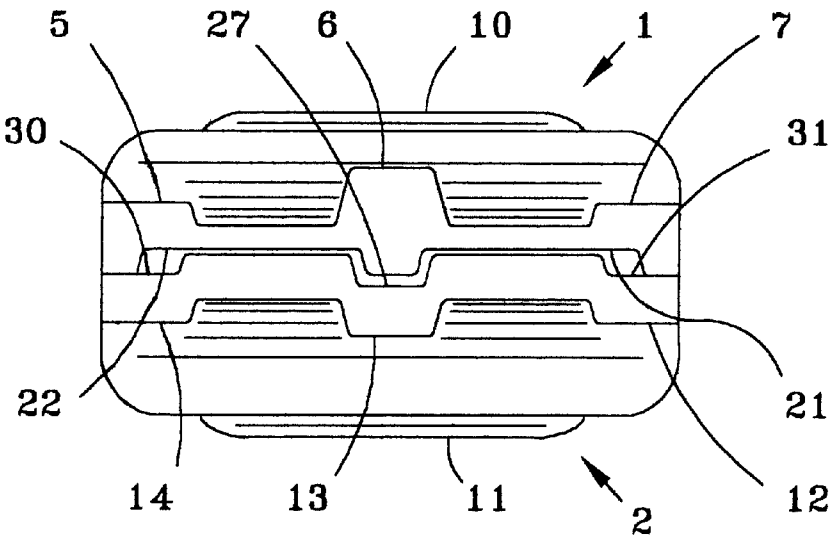
FIG. 4 is an enlarged end view of the hair cutting guide illustrating the hair gripping end portion thereof.

FIG. 4 is an end view of the hair cutting guide illustrating the hair gripping end portion thereof. FIG. 4 illustrates the first exterior ridge 5, the second exterior ridge and the third exterior ridge of the upper clip 1. Similarly, FIG. 4 illustrates the first exterior ridge 12, the second exterior ridge 13, and the third exterior ridge 14 of the lower clip 2. FIG. 4 illustrates how the second exterior ridges 6 and 13 of the upper and lower clip respectively, are raised relative to the other exterior surfaces.

FIG. 4 also illustrates the first interior groove 21 of upper clip 1, the second interior groove 22 of upper clip 1, the first depressed shoulder 30 of lower clip 2, the second depressed shoulder 31 of lower clip 2, and the interior groove 27 of lower clip 2.

Figure 5:
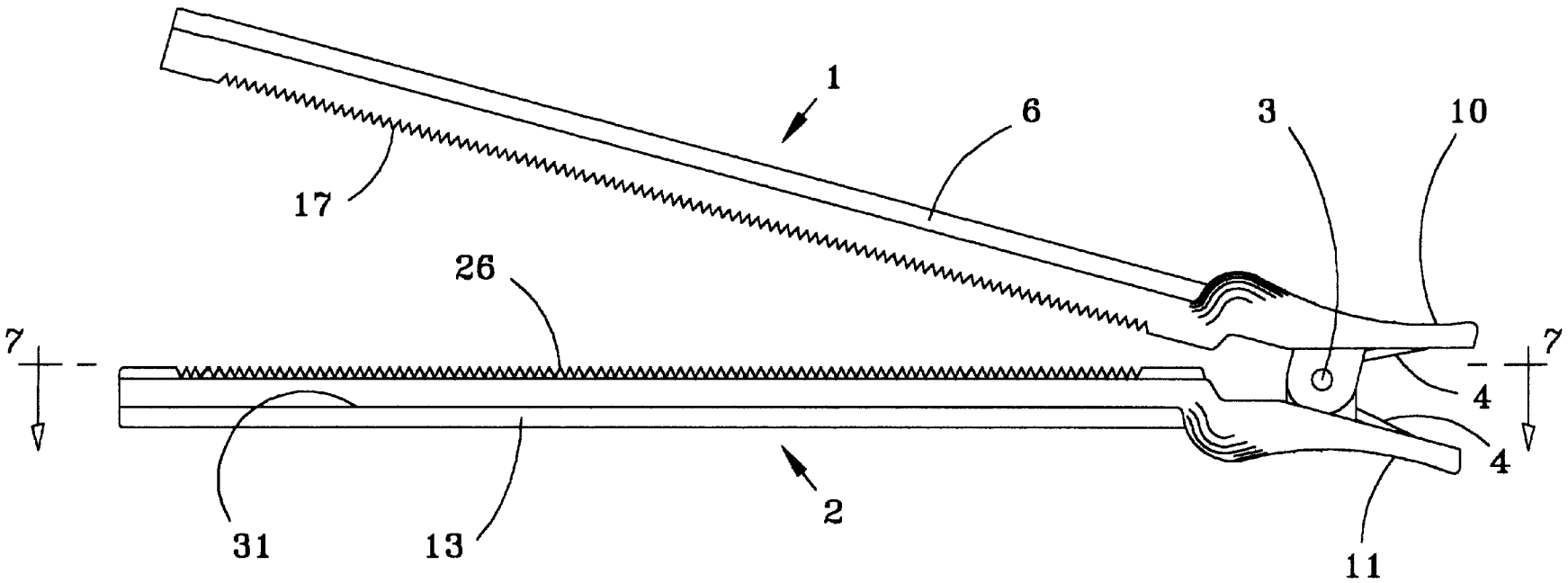
FIG. 5 is a side view of the hair cutting guide illustrating the upper and lower clip pivoting around the pivot pin so as to open the hair cutting guide to receive hair to be cut.

FIG. 5 is a side view of the hair cutting guide illustrating the upper and lower clip pivoting around the pivot pin 3 so as to open the hair cutting guide to receive hair to be cut. The position of the upper and lower clips is achieved by applying force on the thumb grips 10 and 11 by the hands of a person. Also shown in FIG. 5 are the second raised exterior edge 6 of the upper clip and the second raised exterior edge 13 of the lower clip 2. Depressed shoulder 31 is illustrated and when the force to hold the hair cutting guide is removed the third interior toothed ridge 17 abuts the second depressed shoulder 31 of the lower clip 2. FIG. 5 also illustrates the first interior toothed ridge 26 of the lower clip 2.

Figure 6:
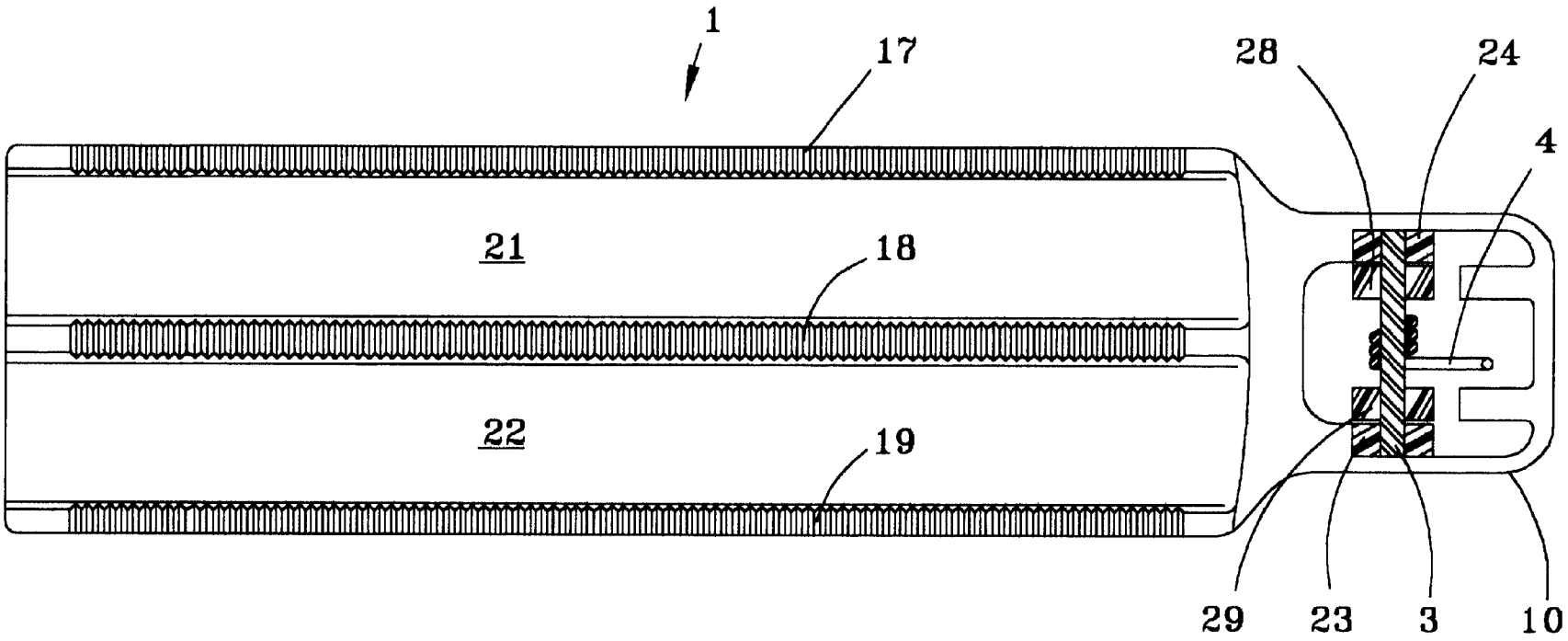
FIG. 6 is a view of the upper clip of the hair cutting guide which illustrates a bottom view of the gripping end and a cross-sectional view taken along the lines 6—6 of FIG. 2 illustrating the pivoting end.

FIG. 6 is a view of the upper clip of the hair cutting guide which illustrates a bottom view of the gripping end and a cross sectional view taken along the lines 6—6 of FIG. 2 illustrating the pivoting end. FIG. 6 illustrates the interior of the upper clip 1. First interior groove 21, second interior groove 22, first interior toothed ridge 19, second interior toothed ridge 18, and third interior toothed ridge 17 of the upper clip are shown in FIG. 6. This portion of the upper clip is discussed herein as being the gripping end portion of the upper clip 1. The pivot pin 3 is illustrated and it is pressed fit into the supports 23, 24 of the upper clip 1 and supports 28 and 29 of the lower clip 2.

Figure 7:
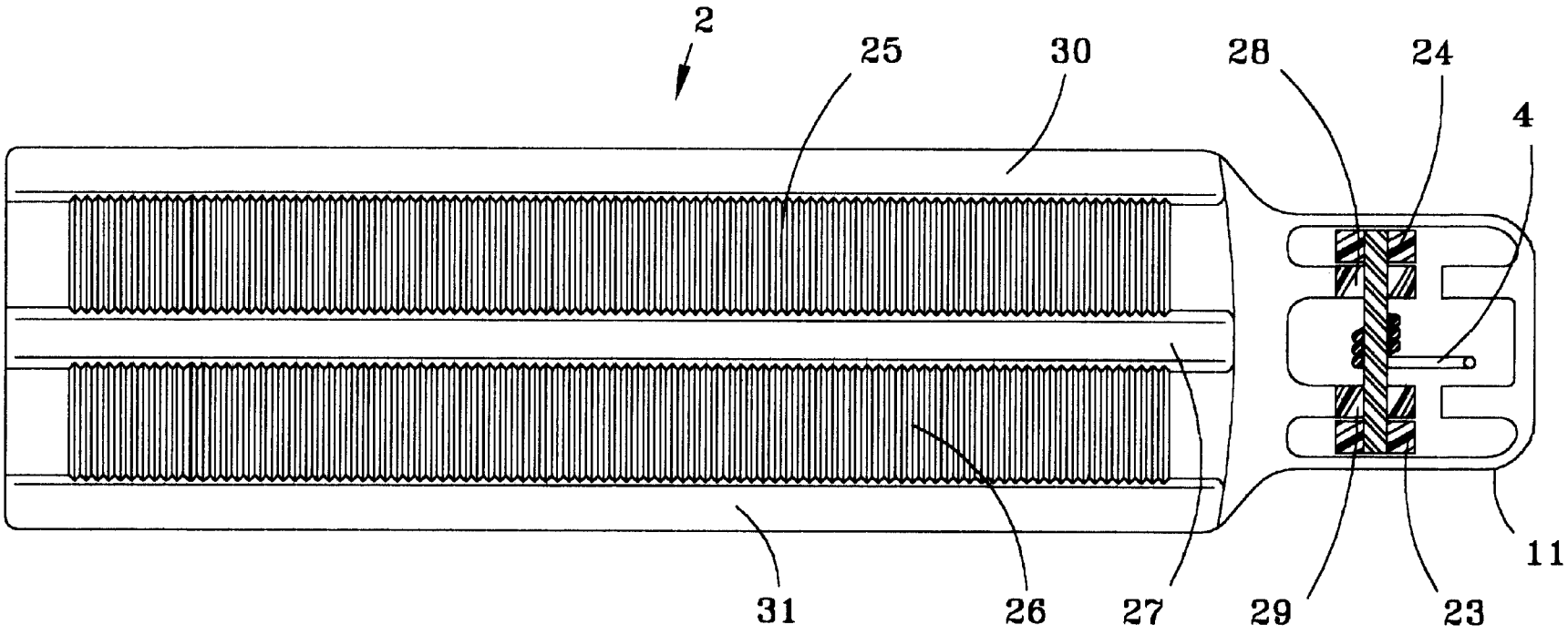
FIG. 7 is a view of the lower clip of the hair cutting guide which illustrates a bottom view of the gripping end and a cross-sectional view taken along the lines 7—7 of FIG. 5 illustrating the pivoting end.

FIG. 7 is a view of the lower clip 2 of the hair cutting guide 20 which illustrates the bottom view of the gripping end and a cross sectional view taken along the line 7—7 of FIG. 5 illustrating the pivoting end. FIG. 7 illustrates the first interior toothed ridge 26 of the lower clip for mating with groove 21 of the upper clip. FIG. 7 also shows the second interior toothed ridge 25 of the lower clip for mating with the groove 22 of the upper clip 1. First depressed shoulder 30 and second depressed shoulder 31 of the lower clip 2 are also illustrated in FIG. 7 and they interfit with the third interior toothed ridge 17 and the first interior toothed ridge 19 of the upper clip 1.

FIG. 2 illustrates the hair cutting guide in its closed position. In this position the hair of a person will reside in the spaces formed by the teeth of the ridges of the upper and lower clips. In the preferred embodiment the teeth of the upper and lower clip align such that there is a clear passageway between the teeth for the hair. In this way the hair cutting guide grips or clamps the hair uniformly such that the hair does not bunch up or become otherwise diverted within the hair cutting guide.

In the preferred embodiment the upper and lower clips of the invention are manufactured from plastic. The pivot pin is press fit into the supports of the upper and lower clip.

It will be understood by those skilled in the art that the clip could be made from many different materials.

It will be understood by those skilled in the art that many changes and modifications may be made to the invention without departing from the spirit and scope of the appended claims.

It will be understood by those skilled in the art that the invention has been set forth by way of example only and the foregoing example is not meant to act in any way as a limitation on the scope of the appended claims.

What is claimed is:

1. A hair cutting guide comprising:

a substantially planar and longitudinally extending upper clip and a substantially planar and longitudinally extending lower clip;

a pivot pin interconnecting said upper and lower clips allowing rotation of said upper and lower clips with respect to each other;

a spring mounted around said pivot pin and engaging said upper and lower clips and urging them into engagement with each other;

said upper and lower clips each include a plurality of longitudinally extending teeth arranged in a plurality of rows and a plurality of longitudinally extending grooves; and, each of said rows of longitudinally extending teeth of said upper and lower clips mate and align with said plurality of grooves in said upper and lower clips.

2. A hair cutting guide as claimed in claim 1 wherein said upper and lower clips each include a thumb grip.

* * * * *